United States Patent [19]

Lehnert et al.

[11] Patent Number: 4,748,771

[45] Date of Patent: Jun. 7, 1988

[54] FIRE DOOR

[75] Inventors: Charles W. Lehnert, Stone Mountain; James R. Van Dyke, Lawrenceville; Ray W. Hinkel, Stone Mountain, all of Ga.

[73] Assignee: Georgia-Pacific Corporation, Atlanta, Ga.

[21] Appl. No.: 760,490

[22] Filed: Jul. 30, 1985

[51] Int. Cl.[4] ..... E05D 7/00

[52] U.S. Cl. ..... 49/399; 52/309.17; 52/813; 428/920

[58] Field of Search ..... 52/785, 232, 811, 813, 52/309.13, 309.17; 428/703; 49/399, 501; 428/920

[56] References Cited

U.S. PATENT DOCUMENTS

| | | | |
|---|---|---|---|
| 2,593,050 | 4/1952 | Paul et al. | 20/35 |
| 3,196,494 | 7/1965 | Hartman et al. | 428/50 |
| 3,987,600 | 10/1976 | Baehr | 52/232 |
| 3,994,110 | 11/1976 | Ropella | 428/920 X |
| 4,075,804 | 2/1978 | Zimmerman | 52/232 |
| 4,104,828 | 8/1978 | Naslund | 49/399 |
| 4,159,302 | 6/1979 | Greve et al. | 264/333 |
| 4,343,127 | 8/1982 | Greve et al. | 52/785 |
| 4,357,384 | 11/1982 | Jasperson | 52/517 |
| 4,517,329 | 5/1985 | Thompson | 428/703 |

FOREIGN PATENT DOCUMENTS

| | | | |
|---|---|---|---|
| 1471240 | 1/1967 | France | 49/501 |
| 1538429 | 1/1979 | United Kingdom | 49/501 |

OTHER PUBLICATIONS

Undated Cal-Wood Door Brochure, No. 8.3/Cal, entitled "The Leader in Architectural Doors", See Especially, pp. 3–4.

*Primary Examiner*—Kenneth J. Dorner
*Assistant Examiner*—Gerald A. Anderson
*Attorney, Agent, or Firm*—John T. Synnestvedt; Kenneth P. Synnestvedt; William T. King

[57] ABSTRACT

A fire door comprising a core and edge banding, the principal ingredients of the core being expanded perlite, gypsum and cement, the edge banding comprising a strip of natural wood, a strip of a cast mixture of which the principal ingredient is gypsum and an intervening strip of plastic laminate.

11 Claims, 2 Drawing Sheets

FIRE DOOR

FIELD OF THE INVENTION AND STATEMENT OF OBJECTS:

This invention relates to fire doors formed primarily of fire-resistant components, each door including a core and edge banding in intimate contact with the edges of the core and providing for reinforcing the edges of the door and for installing or mounting supporting hardware.

The use of fire doors in buildings is an important factor in avoiding injuries and loss of lives and in preventing property damage as a result of their ability to impede the spread of fire. In the interest of public safety, standards have been set by governmental agencies, building code authorities and insurance companies for the installation and performance of door assemblies which retard the passage or spread of fire. Building codes require that fire-resistant door assemblies be installed in wall, openings and that such assemblies pass standard and industry-wide accepted tests which are an evaluation of the fire-resistant properties of the door assembly in relation to heat and flame for a specified duration The fire door contemplated by the present invention is a composite structure comprising a manufactured fire-resistant core which is surrounded by an edge frame comprising banding pieces at least some of which are of tripartite construction including a strip of natural wood, a strip of fiber reinforced plastic laminate, and a strip of a cast gypsum mixture of composition explained hereinafter. The door has a veneer, or other sheet surface covering, usually comprising either wood or plastic. Such a composite door must have certain basic properties in order to meet accepted standards and pass industry-wide accepted fire endurance tests of door assemblies in accordance with ASTM E-152. In these tests, the door and frame are exposed to flame and intense heat such as that generated by fire in a burning building. Exemplary conditions of such tests involve exposing the door to temperatures which progressively increase to values within the range of 1750° to 1800° F. for an exposure period up to 1 ½ hours. Wood composite doors for various locations are required to withstand exposure for different lengths of time, typically 20 minutes, 45 minutes, 1 hour or 1 ½ hour. This invention is primarily concerned with doors meeting the requirements of 45 minute, 1 hour and 1 ½ hour ratings. The fire door of the present invention is also effective in meeting the requirements of hose stream tests, which involve impact, erosion and cooling effects.

It is a general objective of the present invention to provide a fire door meeting the fire code requirements and also providing convenient and economical manufacture, as well as simple and efficient mortising and mounting of the doors by use of standard carpentry or other conventional type tools.

It is also an important object of the present invention to provide a multiple strip edge banding, including strips of the three types mentioned above in which the outer strip which is formed of natural or untreated wood may be reduced in thickness, and in which the composition strip has a formulation not only having effective fire-resistant properties but also serving to contribute to the screw-holding capacity of the edge banding considered as a whole.

It is also an objective of the invention to provide a composite door formed of a molded core and of the tripartite type of composite edge banding above referred to at least the vertical edges of the core, such tripartite edge banding being made up of a plurality of strips of different materials as fully described hereinafter, and not only having good fire-resistant and strength characteristics so as to reinforce the edges of the core and to meet conditions of use, such as door slamming, but at the same time, having integrity and machineability, as well as improved screw holding capacity notwithstanding employment of a wood strip of reduced thickness.

Another objective is to provide composite edge banding which not only has the desired integrity and machineability, but which is also characterized by its ability to retain its strength, integrity and other characteristics throughout a long life.

The invention still further contemplates simplicity in manufacturing techniques, particularly with respect to the edge banding and the application thereof to the edges of the core, while still providing the desired strength and fire-resistant characteristics.

The foregoing and various other objects and advantages will be analyzed in greater detail hereinafter, following some general consideration of the type of construction of fire doors with which the invention is concerned.

BRIEF DESCRIPTION OF THE DRAWINGS

With the foregoing in mind, attention is now directed to the accompanying drawings, in which.

DETAILED DESCRIPTION

Figure 1:
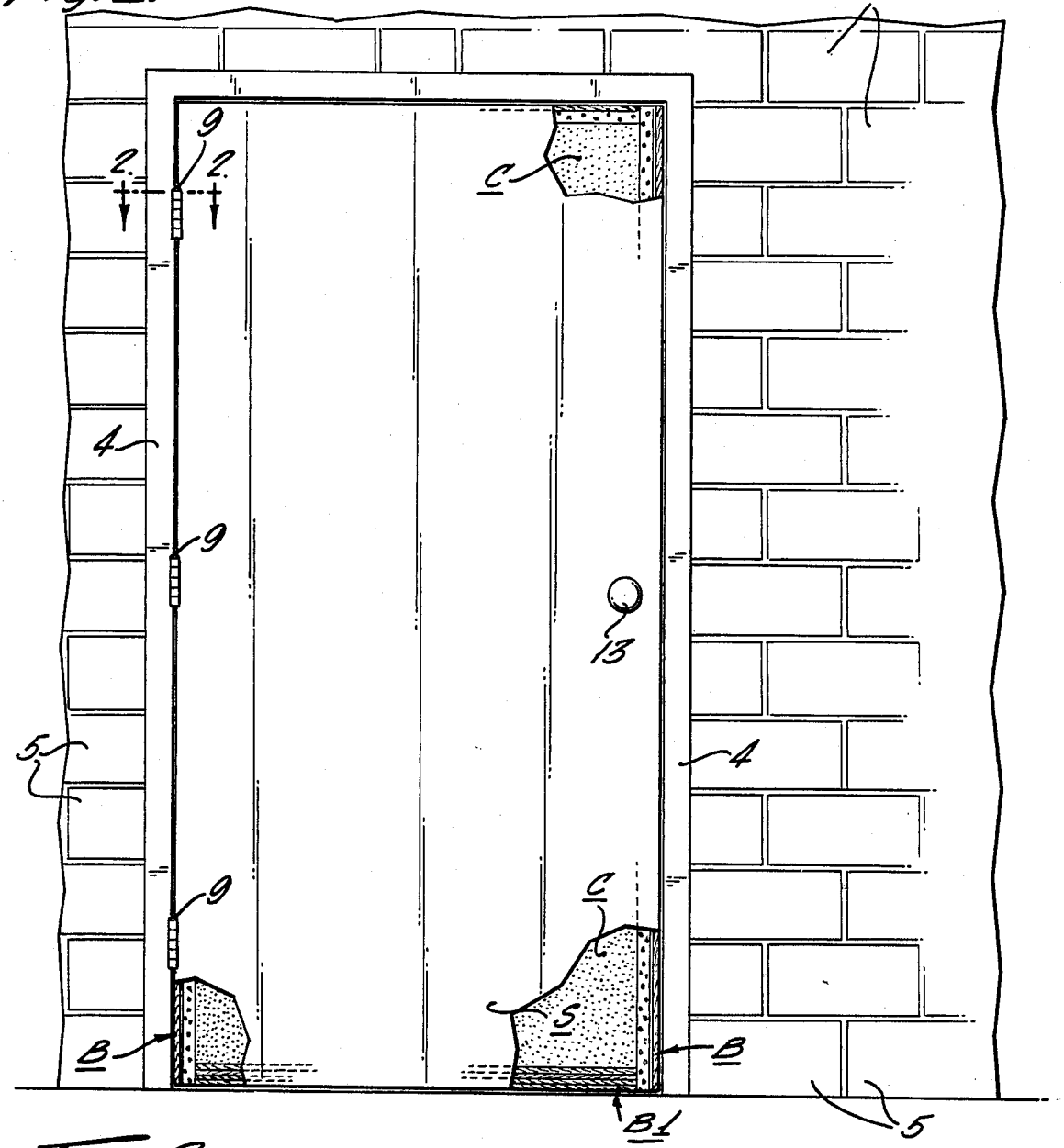
FIG. 1 a face view of a fire door constructed according to the present invention and mounted in a cinder block wall, portions of the door being broken out and illustrated in section.
Figure 2:
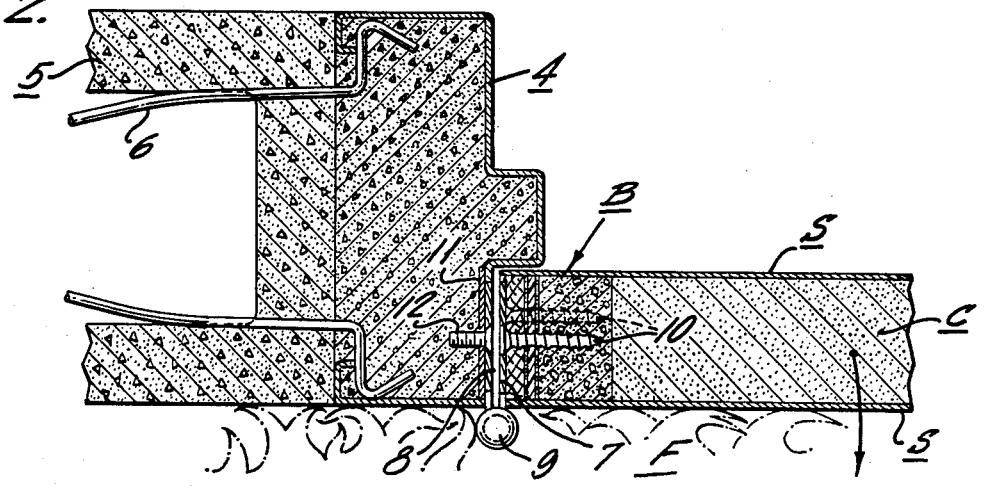
FIG. 2 an enlarged fragmentary horizontal sectional view of an edge portion of the door and edge banding, as mounted in a door jamb, this view being taken as indicated by the section lines 2—2 on FIG. 1.
Figure 3:
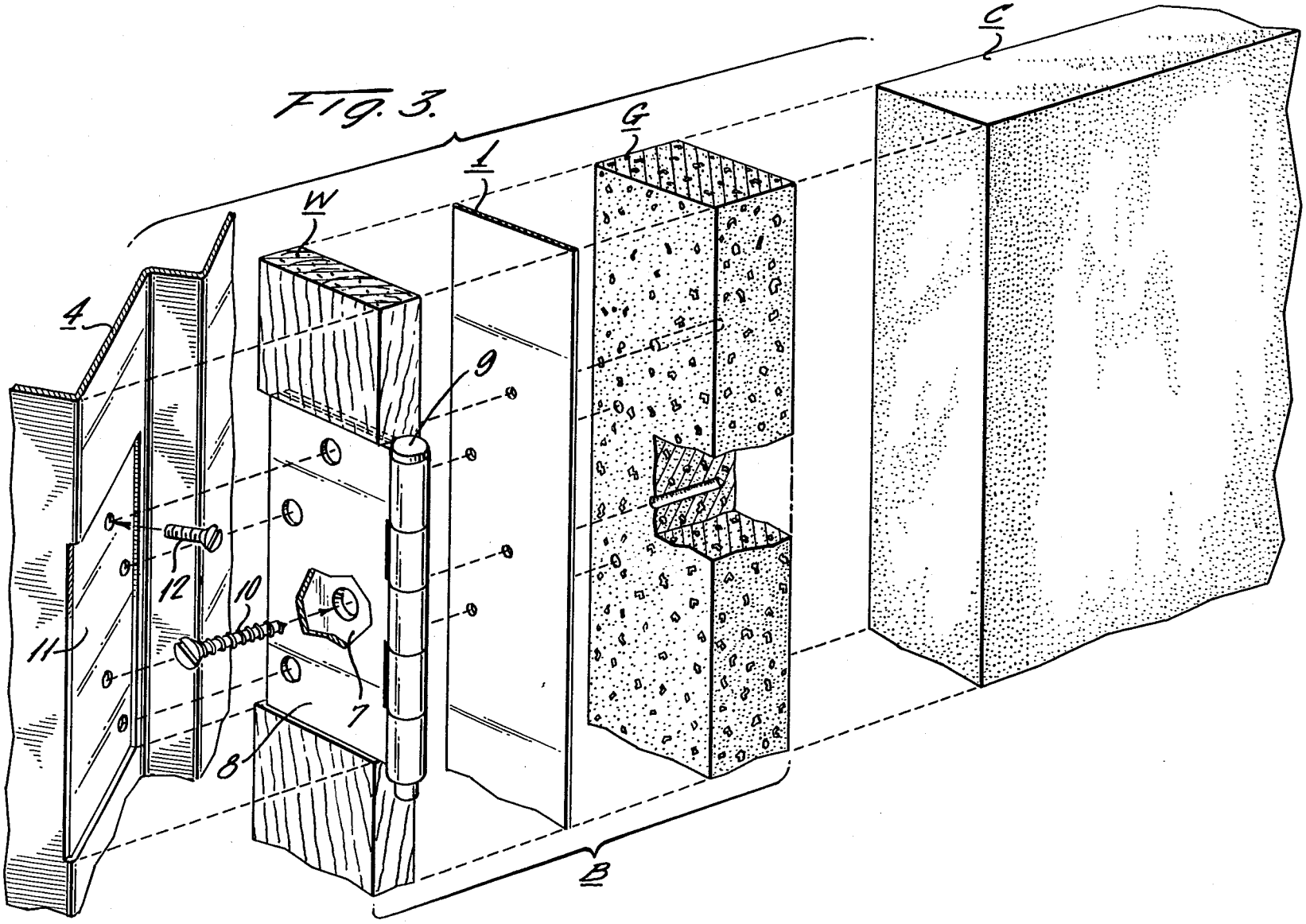
FIG. 3 is an enlarged exploded fragmentary view of portions of a door and edge banding and certain parts included in the hinge mounting arrangement

In the detailed description given hereinafter, reference is first made to the general structure of the door as illustrated in FIGS. 1 to 3. Thereafter, description is given concerning the composition and manufacture of the edge banding.

A typical fire door constructed according to the present invention is illustrated in FIGS. 1 to 3. The door is made up of a core C formed in the manner described hereinafter and edge banding, indicated generally by the letter B, is applied to the edges of the core, the vertical pieces of the banding being of composite tripartite construction as will be described more fully hereinafter. The bottom piece B1 of the edge banding is preferably formed at least in part of treated wood as explained hereinafter. Preferably, both sides of the door are covered with sheet material as indicated at S, in the form of wood veneer, plywood, or a plastic laminate For reasons fully brought out hereinafter, each of the composite edge banding pieces used for the vertical strips, and also if desired for the top edge, is desirably formed of three adhesively bonded strips, as best seen in FIG. 3, one strip being in the form of a wood strip indicated at W, a second strip in the form of a plastic laminate as indicated at L and the third in the form of a gypsum based composition indicated at G. In the embodiment of the door shown in FIG. 3, the gypsum strip G has a flat surface positioned adjacent to the edge of the core, with the plastic laminate strip L positioned at the outer side of the gypsum strip G and with the wood strip W at the outer side of the strip L.

Although the invention is particularly concerned with the combination of a certain type of edge banding with a variety of types of fire door cores, one example of a core useable in the manufacture of the fire doors contemplated according to this invention is disclosed in the U.S. Pat. No. 4,159,302 of Dale R. Greve and Turner W. Richards, issued June 26, 1979, and also in the U.S. Pat. No. 4,343,127 of Dale R. Greve and Charles W. Lehnert, issued Aug. 10, 1982, both assigned to the assignee of the present application. Some description of the fire door of said patents and of the method for manufacture thereof is briefly presented herebelow, but it is to be understood that the present invention may be employed when using a variety of specific embodiments of the cores. Preferably, however, the cores employed in the combination of the present invention are cores which contain at least some calcined gypsum, in addition to at least 50% of expanded perlite.

Cores suitable for use in doors having the improved edge banding of the present invention may be formed of a set composition comprising the set product of an aqueous mixture, based on the total weight of the dry ingredients in the mixture, of:

(A) about 50 to about 70 wt. % of expanded perlite;
(B) about 10 to about 30 wt. % of calcined gypsum;
(C) about 10 to about 20 wt. % of hydraulic cement;
(D) about 1 to about 5 wt. % of an organic binder;
(E) 0 to about 4 wt. % of unexpanded vermiculite;
(F) 0 to about 4 wt. % of clay, and
(G) 0 to about 1 wt % of fibrous reinforcements.

The mixture from which the set core is made contains also water in an amount at least sufficient to provide the stoichiometric amount of water needed to cause the setting of the calcined gypsum and hydraulic cement. It is generally expedient to include an amount of water in excess of the stoichiometric amount. For ease of manufacture, it is preferred that the amount of water be no greater than that needed to provide a damp mixture of the ingredients. The set core can be produced more readily from a damp mixture of the ingredients than from a slurry thereof. The set core can be prepared readily from about 25 to about 60% of water based on the weight of the dry ingredients comprising the mixture.

Typical cores useable in doors of the present invention can be prepared having a compressive strength of at least about 200 lbs /sq. in. and ranging up to about 400 lbs./sq. in. Such cores may also have a density within the range of about 22 to about 35 lbs./cu. ft.

Although certain fire door edge banding has heretofore been employed in the form of wood strips chemically treated to improve fire resistance, the present invention contemplates employment of a composite edge banding in order to further increase the fire resistance of the banding itself and thus of the combination of the banding with the fire door core, while at the same time providing certain other advantages, as will be explained. According to the preferred practice of the present invention, such composite edge banding pieces are employed at least at the two vertical edges and if desired, also at the top edge of the door. At the bottom edge of the door an edge banding piece is preferably used comprising either a single strip of fire-treated wood, or compressed wood fiber material, or a wood strip combined with a composition strip.

It is contemplated according to the present invention that the composite edge banding pieces employed at the vertical edges and possibly also the top edge be made of three strips of material, one of which comprises a natural or untreated wood strip, for instance Douglas fir, another of which comprises a strip formed primarily of gypsum dihydrate, preferably in combination with lesser amounts of certain other ingredients as will be explained, and the third of which comprises a strip of fiber reinforced thermoset plastic laminate, the third strip lying between and being adhesively bonded to the wood and composition strips. The tripartite composite edge banding piece is secured to the core with the gypsum strip lying adjacent to the edge of the core and with the wood strip at the outer side of the banding, for reasons which will be explained. The strips of the banding are preferably adhesively bonded together, as by a hot melt adhesive.

The edge banding should at least be in intimate contact with the edge of the core and may be adhesively bonded to the core; and it is here further noted that securing of the edge banding to the core may be at least in part accomplished by adhesively bonding the facing sheets not only to the core but also to the edge banding.

The invention contemplates the employment of the composite or multiple strip edge banding pieces at the side edges of the core in order to retain certain of the desirable characteristics of the wood, namely the ready workability with carpentry or other conventional tools, and the aesthetics of the natural wood in the outer edge portion of the banding elements. The wood strip is much more readily trimmed to fit the opening and mortised to receive hinges, locks and other hardware than the gypsum strip.

By employing the composite banding pieces at the top and vertical edges of the core and applying the banding pieces with the gypsum strip adjacent to the core and the wood strip at the outer or exposed edge, the presence of the remaining thin strip of wood does not appreciably impair fire resistance. An important reason for this is that in the application or mounting of a fire door in a doorway, the edge of the door at one side face normally abuts a stop along the door frame on the vertical and top horizontal jamb surfaces; and this overlap of the stop and the wood strip of the edge banding pieces provides, in effect, for thermal shielding by allowing the door jamb stop to conceal or block the opening even if the wood burns away, thereby preventing the passage of flames.

As indicated above, the plastic laminate strip which is positioned between the wood strip and the composition strip is desirably formed by molding under heat and pressure a layer of fiber reinforced thermosetting resin such as urea formaldehyde. This layer may have a thickness of the order of about 0.05 inch. After formation of the strip and before assembly with the wood and composition strips, the opposite surfaces of the plastic laminate strip are desirably mechanically treated, for example, by abrasive sanding, in order to eliminate high gloss or sheen and thereby provide for more effective adhesive bonding of the laminate strip to the adjoining surfaces of the wood and composition strips.

The presence of the plastic laminate strip between the wood and composition strips is of advantage in the assembly, for a number of reasons. The sandwiching of the plastic laminate strip between the wood and composition strips serves to stiffen the plastic laminate and thus permit it to develop its full strength and screw-holding capability. Still further the sandwiching of the plastic laminate enhances the strength of the assembly, and particularly of the composition strip.

The plastic laminate strip facilitates the use of a wood strip in untreated form, i.e., a form in which the wood is not impregnated with a fire-resistant material, and therefore eliminates the problems associated with efflorescence of the fire retardant salts which occurs where impregnated wood is employed. Efflorescence impairs the appearance of the wood, reduces fire resistance and hinders finishing. Applicants' employment of untreated wood obviates the disadvantages of efflorescence and eliminates the necessity for applying sealing coatings.

It is still further advantageous to be able to use untreated wood strips in the edge banding, because treated wood strips manifest substantial hygroscopicity, which is disadvantageous in the edge banding. Moreover, impregnation treatment of the wood, which is customarily done under pressure, tends to weaken the wood itself.

The plastic laminate strip enables the use of a wood strip which is thinner than would otherwise be needed; and the strip of plastic laminate is less expensive than fire-treated wood.

Certain desirable mechanical properties are contributed by the strip of plastic laminate including the fact that the plastic laminate tends to restrain screws used for the mounting of hinges from "backing off", i.e., loosening, and the plastic laminate strip also tends to prevent "threading out" of screws, i.e., the tendency for a power screwdriver to cause the screw to continue to rotate after it has bottomed. The plastic laminate strip tends to inhibit a carpenter from using nails for starting the formation of the hole for a screw, which function is better performed by a drill.

The tripartite strip is more resistant to warping or bowing than is edge banding composed of only two strip members, because, in the case of just two strip members there is a pronounced tendency for differential expansion and contraction of the two strips to occur under certain conditions.

The gypsum strip for the composite edge banding pieces according to the present invention desirably includes ingredients as listed below:

| | Weight % of Set and Dried Composition |
|---|---|
| gypsum dihydrate | 65–75 |
| clay | 4–5.5 |
| raw vermiculite | 4.5–5.5 |
| glass fiber | 0.7–1.5 |
| wood chips | 5–7 |
| paper fiber (kraft or sulfite) | 0.8–1.3 |
| resin binder (solids) | 9.5–11.5 |
| dispersant | 0.7–1.3 |
| accelerator | 0.7–1 |
| defoamer | 0.01–0.03 |

Preferably, the several ingredients are used in the neighborhood of about the following percentages:

| | Weight % of Set and Dried Composition |
|---|---|
| gypsum dihydrate | 68 |
| clay | 5 |
| raw vermiculite | 5 |
| glass fiber | 1 |
| wood chips | 6 |
| paper fiber (kraft or sulfite) | 1 |
| resin binder (solids) | 11 |
| dispersant | 1 |
| accelerator | 1 |
| defoamer | trace |

As a specific example, the following formulation has been used:

| | Weight % of Set and Dried Composition |
|---|---|
| gypsum dihydrate | 68.24 |
| clay | 5.03 |
| raw vermiculite | 5.03 |
| glass fiber | 1.05 |
| wood chips | 6.43 |
| sulfite paper fiber | 1.17 |
| vinyl resin emulsion (solids) | 11.1 |
| dispersant (lignosite) | 1.02 |
| accelerator | 0.91 |
| defoamer | 0.02 |

Although various resins may be employed, a particularly effective resin emulsion is one manufactured by Union Carbide and identified as UC 130, being a polyvinyl acetate homopolymer. The resin just mentioned is a thermoplastic resin and it is preferred to employ a thermoplastic resin, rather than a thermosetting resin. The heat required to set a thermosetting resin tends to calcine the gypsum in the composition strip being formed. Another thermoplastic resin which has been found useable is known to the trade as Rhoplex AC-388, being an acrylic resin manufactured by Rohm and Haas.

In selecting the resin, it is preferred to employ thermoplastic resins, which when applied to a surface, tend to form a tough film, rather than a brittle film or one which is soft and has very low tensile strength, as is readily determined by peeling the formed dry film from a smooth surface on which the resin was applied.

Preferably, the gypsum composition strip is preformed by a casting technique, i.e., a technique in which an aqueous slurry of the ingredients is delivered onto a moving belt, for example of the kind employed in the manufacture of gypsum wallboard, and the slurry is dried by application of heat, the quantity of the ingredients above referred to being given for the set and dry composition. The water may be introduced into the mixture by way of the aqueous emulsion of the resin. Paper covering sheets may be incorporated in the casting operation, as is customarily done in the gypsum wallboard technique, and may be stripped off after the gypsum has set sufficiently to have the strength to be self-supporting. After the casting operation, strips of the desired size may be cut from the casting.

Other "casting" techniques may be used, i.e., techniques in which the desired strip is preformed from a slurry or suspension of a mixture of particles of various of the ingredients. It is pointed out that the reference herein to the "casting" of the gypsum composition strip is not to be understood as limited to specific techniques either with or without pressure, but preferably the composition is formed from a slurry in a manner providing a set and dry composition of substantial density. In the specific example and preferred range given above, the density will be of the order of 60 to 65 lbs./cu. ft. The density of the composition strip should be at least 50 lbs. and may vary from about 50 to about 75 lbs./cu. ft. depending upon the quantities of the ingredients employed.

It will be observed that in common with the composition for the core, the composition for the edge banding contains gypsum and in addition also contains clay and raw vermiculite, both of which latter are also preferably included in the core formulation. In the edge banding composition, as in the core composition, the vermiculite and clay are modifying ingredients which reduce the shrinkage of the gypsum which occurs, for instance, in a fire test. Moreover, the edge banding composition without clay or vermiculite would still have some fire resistance, but not as much as when these ingredients are present.

Before considering certain of the distinctive advantages of the arrangement of the invention, reference is again made to the accompanying drawings showing, not only the components of the tripartite edge banding itself, but also the assembly of the edge banding with the core of the door and the mounting of the edge banded core in a typical doorway frame.

The door frame illustrated in the drawings comprises a double-rabbetted metal frame element 4 mounted in an opening in a wall, for instance, in the cinder block wall indicated at 5 in FIGS. 1 and 2. This frame element may be mounted in the wall structure in a conventional manner, including, for example, wire anchors, such as 6. The door itself is desirably mounted by a plurality of hinges, each comprising a pair of hinge plates 7 and 8 connected by means of the hinge pin 9. In FIG. 3, the frame element 4 is shown in a position inclined to the left in order to better illustrate the installation of various parts. As clearly appears in FIG. 3, the wood strip W is mortised in order to accommodate the hinge, and the hinge plate 7 is fastened by means of screws 10 which extend through the wood strip, and through the plastic laminate strip L and into the composition strip G.

The door frame element 4 is provided with a plate insert 11, preferably welded to the element 4 and provided with threaded apertures mating with the apertures of the hinge plate 8. The hinge plate 8 is connected with the plate 11 and thus with the frame element 4 by means of machine type screws indicated at 12.

Other hardware, such as a latch operated by a doorknob shown at 13, may also be provided on the door in an arrangement associated with the opposite side of the door frame.

The stiles, i.e., the vertically positioned edge banding pieces, are preferably formed and constructed in the manner shown in FIGS. 1, 2 and 3 and as described above. At the upper edge of the door, a horizontal rail is desirably provided, and this rail may comprise a piece of edge banding of the tripartite type described above, but, if desired, this upper rail may be of simpler construction, partly because it is not there necessary to mount hinge or latch components.

For convenience in fitting the door to the doorway, the bottom rail may, if desired, be made of a single piece of wood, in which event it would be preferred that this be a wood strip treated with fire retardant chemicals. This lower rail may alternatively be formed in various other ways, for instance, by multiple laminate of layers of fire retardant treated wood strips, some of which may comprise molded particulate wood or pressed wood fiber material. Still further, the bottom rail may be formed of a plurality of laminated layers comprising both wood and gypsum composition strips.

The vertical stiles, however, are desirably formed in the manner described above, including the tripartite construction comprising a relatively thin untreated wood strip, a gypsum composition strip, and an intervening plastic laminate strip bonded together and the assembly mounted against the core as above referred to.

There are several reasons why the invention contemplates use of the fire retardant wood for the bottom edge banding piece. In considering this matter it is first noted that the conventional door jamb does not have a door stop at the inside surface at the bottom of the doorway, in view of which the protection afforded at the top and sides of the doorway by such a stop is not present at the bottom of the doorway. In addition, the bottom edge banding piece (or rail) is normally relied upon to provide adequate tolerance for trimming the height of the door to fit the doorway, and for practical trimming leeway a bottom rail or piece of substantial vertical dimension is needed. Therefore, the invention contemplates use of a bottom banding piece of greater total vertical dimension than the banding pieces used at the top and vertical edges and at the same time contemplates employment of fire retardant wood for the bottom piece rather than the natural wood employed in the composite banding pieces used at vertical edges.

One of the important characteristics of the edge banding composition is the screw-holding power, this being of particular importance since hinge butts for the door hinges are customarily screw attached to the edges of the banding. The presence of the wood chips and fibers in the gypsum strip of the edge banding is important in contributing screw-holding power, as is also the employment of a substantial quantity of the resin. Still further, the presence of fibers contributes to the bondability of the gypsum strip with reference to adhesives employed for securing the banding directly to the edges of the core, or employed in securing the veneer or other sheets at the faces of the door, such covering sheets ordinarily covering the core itself and also overlapping the banding.

The resin emulsion is also of great importance in providing adequate screw-holding capacity, particularly in combination with the fibers present. The resin also contributes strength to the composition strip of the edge banding.

The presence of some glass fibers is of importance in maintaining the integrity of the gypsum strip during exposure to fire and hose stream. It also contributes to the strength of the gypsum strip.

With respect to the wood employed, it is to be noted that the use of treated wood in the banding has certain disadvantages. For example under conditions where changes in humidity result in alternate absorption and release of moisture from the wood, there is a tendency for migration of the fire-retardant salts to the surface of the wood at times when moisture is released. This tends to leave deposits of the salts on the surface of the wood which is undesirable because it also interferes with the bonding of the facings.

By employment of natural wood in the composite banding pieces, the invention provides the advantages incident to employment of natural (instead of treated)

wood at at least two of the edges of the door, i.e., at the vertical edges and attains these advantages without sacrificing fire resistance.

According to the present invention it is contemplated that in the composite banding pieces, natural wood be employed, i.e., untreated or unimpregnated wood, such as fir, hemlock, alder, maple or yellow pine, and preferably the wood strip of each composite banding element or piece consists of a single piece of wood rather than multiple layers or plywood.

We have further found that a composite edge banding made with a strip of the gypsum composition described and a strip of natural wood and having an intermediate strip of plastic laminate, will have adequate fire resistant properties, particularly if the thickness of the wood strip is kept below about ⅜". One reason why the thin natural wood strip does not detract from the fire resistance, will be apparent from examination of FIG. 2 which shows one edge of a banded fire door fitted in a door jamb 4. Conventional door jambs commonly have a stop portion as illustrated, and this is ordinarily provided at least on the vertical and top horizontal jamb surfaces. In the conventional metal door frame the door stop on the vertical and top surfaces of the jamb has a depth of ⅝", and as clearly appears from FIG. 2, the stop overlaps the wood strip W, and this in itself aids in preserving the fire resistance of the door or doorway as a whole, notwithstanding the use of the natural or untreated wood in the composite banding pieces. Thus, if the side of this structure, indicated by the letter F in FIG. 2, is exposed to fire, it will be seen that even if the wood strip burns away, the spread of fire is impeded by the presence of the overlapping door stop. On the other hand if the fire approaches the doorway from the opposite side, the door stop protects the wood strip.

The wood strip of the composite banding pieces is effective in preserving the integrity of the edge of the fire door even in spite of cutting away portions of the wood strip for the mounting of hinges, door locks or the like. The wood itself even when only a thin strip is present is less subject to damage from mortising than is the gypsum composition of which the inner strip of the banding is formed, and the presence of the plastic laminate strip between the inner composition strip and the outer wood strip contributes additional strength to the wood strip which is of special importance where the mortising has reduced the wood strip to a small thickness dimension.

The strips of the composite banding elements may be applied sequentially, i.e., a gypsum composition strip may first be applied and thereafter, a plastic laminate strip is adhesively applied, and then a wood strip may be adhesively bonded to the plastic laminate strip, but it is preferred to preassemble and prebond the three strips, because this minimizes registration and clearance problems in assembly. It is particularly desirable to have the composite banding elements in the position of edge stiles because these represent the edges of the door to which the hinges are applied and to which door latches and attachment of other hardware may be required. As above noted, the presence of the wood facilitates machining and various operations performed by carpentry tools.

For the purpose of maximizing fire resistance, it is preferred to employ a wood strip in the composite banding elements somewhat thinner than the gypsum strip thereof.

After cutting to accommodate hinge butts the remaining wood strip is, of course, thinner than the initial wood strip; and in view of these dimensional relationships, it is of importance that the underlying strips have substantial screw-holding capacity. The density of the plastic laminate strip and of the gypsum composition strip containing fibers and also a substantial quantity of thermoplastic resin, are all factors of significance in establishing screw-holding capacity adequate to meet the demands of securing hinges and latch plates capable of withstanding normal use. Edge banding having gypsum composition strips formulated in the manner above referred to, especially within the preferred ranges of the ingredients as given above, will have a screw-holding capacity of at least 500 lbs., and it is preferred that the screw-holding capacity be in excess of 500 lbs. for edge banding in which the wood strip is ½ inch in thickness, the plastic laminate is 0.05 inch in thickness and the gypsum composition strip is 1 inch in thickness. This value may be determined by a simple screw-holding test accomplished by drilling a 5/32" pilot hole in a piece of the banding. A 2" long number 12 sheet metal screw is then inserted completely through the pilot hole and the screw is pushed to failure, and the screw-holding capacity measured as the value in pounds at the point of failure.

It should be noted that the door assembly provided in accordance with the practice of the present invention meets the conditions of acceptance of fire tests, such as those referred to hereinabove. In addition, the employment of the tripartite composite banding, comprising a strip of gypsum based material, a strip of plastic laminate, and a strip of wood in combination with the core formed of materials as described, including gypsum, also has improved fire resistance because of the employment of the tripartite banding, while, at the same time, affording special advantages in connection with the final trimming after laminating the veneers or facings and after the carpentry required in the mounting of the doors.

The employment of the three components of the edge banding, as described above, serves many purposes in enhancing the effectiveness of the edge banding under varying conditions of use; and we have found that it is of particular significance that the tripartite banding includes, as an intermediate component, a strip of a plastic laminate prepared under heat and pressure with a thermosetting resin, because the inner component which is formed of a gypsum composition, and the outer component which is formed of untreated wood, both have surfaces having substantial porosity, and those surfaces are isolated from each other by the presence of the intervening plastic laminate strip. The plastic laminate serves this purpose even though it is relatively thin and, since the surfaces of the plastic laminate strip are substantially imperforate, the presence of the plastic laminate strip aids in providing an effective adhesive bond between all three components, which would not be as effective in a situation where the gypsum strip and the wood strip are directly adhesively secured to each other. These advantages of the tripartite strip of this invention are achieved while, at the same time, employing a gypsum composition strip having a composition which is effective in reducing disintegration under varying conditions, such as projection of a hose stream.

What is claimed is:

1. Edge banding applied to a planar fire door core having a mean plane and planar edge surfaces perpendicular to said mean plane, the edge banding comprising a strip of natural wood, a strip of fiber reinforced thermoset plastic laminate and a strip of a cast gypsum mixture of the following composition:

| | Weight % of Set and Dried Composition |
|---|---|
| gypsum dihydrate | 65–75 |
| clay | 4–5.5 |
| raw vermiculite | 4.5–5.5 |
| glass fiber | 0.7–1.5 |
| wood chips | 5–7 |
| paper fiber (kraft or sulfite) | 0.8–1.3 |
| resin binder (solids) | 9.5–11.5 |
| dispersant | 0.7–1.3 |
| accelerator | 0.7–1 |
| defoamer | 0.01–0.03 |

said cast mixture having a density of at least 60.0 lbs./cu. ft., each of said strips having a pair of oppositely facing surfaces lying in a plane transverse to the mean plane of the fire door core to which the banding is to be affixed, one of said pair of strip surfaces facing inwardly toward the fire foor core edge, the other of said pair of strip surfaces facing outwardly away from the fire door core edge, the inwardly-facing surface of the plastic laminate strip being adhesively fastened to the outwardly surface of the gypsum composition strip, and the outwardly-facing surface of the plastic laminate strip being adhesively fastened to the inwardly-facing surface of the wood strip, the inwardly-facing surface of the gypsum composition strip being presented for fastening along an edge surface of the fire door.

2. Fire door edge banding as defined in claim 1 wherein said plastic laminate strip comprises thermoset resin material reinforced with kraft paper fibers.

3. Fire door edge banding as defined in claim 1 wherein said natural wood strip, plastic laminate strip and cast gypsum composition strip have dimensions between the oppositely presented surfaces thereof of the order of about $\frac{5}{8}$ inch, 0.05 inch, and 1 inch, respectively.

4. A fire door for use in a doorway having vertical and horizontal jamb surfaces with a door edge stop positioned inside at least one of the vertical jamb surfaces, the door comprising a planar door core having a mean plane and vertical and horizontal planar edge surfaces perpendicular to said mean plane, and edge banding on at least one of the veritcal edges of the core, the core comprising a slab molded from a fire resistant composition, and the edge banding comprising an assembly of at least three strips, the outermost strip being a strip of natural wood, an intermediate strip being formed of fiber reinforced plastic laminate, and an innermost strip being formed of a cast gypsum composition, said strips having a pair of oppositely presented surfaces transverse to the mean plane of the door core, said edge banding being mounted at an edge of the core with the wood strip positioned outward of the plastic laminate strip, said gypsum composition strip being positioned at the edge of the core, and the plastic laminate strip being positioned between the gypsum composition strip and the wood strip, said wood strip having a thickness in the direction of the mean plane of the core, which thickness is not greater than the depth of the door edge stop inside the jamb surface, so that thermal shielding of at least the wood strip is provided by the door edge strip at the jamb surface of the door.

5. The fire door of claim 4 wherein a door hinge is fastened to the edge banding, the hinge being positioned in abutting relation to the outwardly facing surface of the wood strip and fastened in place by screws, said hinge-fastening screws penetrating at least into said strip of cast gypsum composition.

6. A method for making an edge-banded fire door comprising molding a door core from a mixture of particulate materials including at least 50 weight % of expanded perlite, at least 10 weight % of calcined gypsum, and an aqueous binder, compressing said mixture to form a molded door core having edges transverse to the mean plane of the core, pre-assembling edge-banding from a strip of natural wood, a strip of fiber reinforced thermoset plastic laminate, and a strip of cast gypsum composition, the gypsum composition strip being cast from particulate materials including at least 60 weight % of calcined alpha gypsum, fibers, an accelerator and an aqueous binder, and each of said strips having a pair of oppositely presented surfaces, one of said surfaces facing outwardly and the other of said surfaces facing inwardly, the inwardly-facing and outwardly-facing surfaces of the plastic laminate being adhesively fastened to the outwardly-facing surface of the gypsum composition strip and the inwardly-facing surface of the wood strip, respectively; and after the strips are adhesively fastened together, fastening the assembled edge banding along the edges of the core with the inwardly-facing surface of the cast gypsum composition strip against the edge of the core.

7. A fire door comprising a core and tripartite edge banding, the core having a mean plane and planar edge surface perpendicular to the mean plane of the core and comprising a molded fire-resistant composition having a density of not more than 35 lbs./cu. ft., and the tripartite edge banding comprising a composite of at least three strips comprising a first strip of natural wood, a second strip of fiber reinforced thermoset plastic laminate, and a third strip of a cast mixture of the following ingredients in the weight percentages indicated:

| | Weight % of Set and Dried Composition |
|---|---|
| gypsum dihydrate | 65–75 |
| clay | 4–5.5 |
| raw vermiculite | 4.5–5.5 |
| glass fiber | 0.7–1.5 |
| wood chips | 5–7 |
| paper fiber (kraft or sulfite) | 0.8–1.3 |
| resin binder (solids) | 9.5–11.5 |
| dispersant | 0.7–1.3 |
| accelerator | 0.7–1 |
| defoamer | 0.01–0.03 |

said cast mixture having a density of from about 60 to about 75 lbs./cu. ft., each of said strips having a pair of oppositely presented surfaces transverse to the mean plane of said core, one of said strip surfaces facing inwardly toward the core edge, the other of said strip surfaces facing outwardly away from the core edge, the inwardly-facing surface of the plastic laminate strip being adhesively fastened to the outwardly-facing surface of the gypsum composition strip, the outwardly-facing surface of the plastic laminate strip being adhesively fastened to the inwardly facing surface of the wood strip, and the inwardly-facing surface of the gypsum composition strip being mounted against at least one core edge.

8. The fire door of claim 7 wherein the tripartite edge banding is fastened to at least vertically disposed edges of the core.

9. Edge banding according to claim 1 and having a screw holding capacity of about 500 to about 750 lbs.

10. Edge banding according to claim 1 in which the banding comprises a wood strip, a plastic strip and a composition strip having dimensions between the oppositely presented surfaces thereof of the order of about ½ inch, 0.05 inch and 1 inch, respectively, and having a screw holding capacity on the order of about 740 lbs.

11. Edge banding according to claim 1 in which the several ingredients of the cast gypsum mixture are used in the neighborhood of about the following percentages:

| | Weight % of Set and Dried Composition |
|---|---|
| gypsum dihydrate | 68 |
| clay | 5 |
| raw vermiculite | 5 |
| glass fiber | 1 |
| wood chips | 6 |
| paper fiber (kraft or sulfite) | 1 |
| resin binder (solids) | 11 |
| dispersant | 1 |
| accelerator | 1 |
| defoamer | trace |

* * * * *

UNITED STATES PATENT AND TRADEMARK OFFICE

CERTIFICATE OF CORRECTION

PATENT NO. : 4,748,771

DATED : June 7, 1988

INVENTOR(S) : Charles W. Lehnert et al

It is certified that error appears in the above—identified patent and that said Letters Patent is hereby corrected as shown below:

| | |
|---|---|
| Title Page | Last U.S. Patent Reference Cited "4,517,329" should read --4,517,239-- |
| Col. 11, Line 26 | "foor" should read --door-- |
| Col. 11, Line 51 | "veritcal" should read --vertical-- |
| Col. 12, Line 37 | After "than" insert --about-- |

Signed and Sealed this

Twenty-second Day of November, 1988

*Attest:*

*Attesting Officer*

DONALD J. QUIGG

*Commissioner of Patents and Trademarks*